US008197026B2

(12) United States Patent
Kato et al.

(10) Patent No.: US 8,197,026 B2
(45) Date of Patent: Jun. 12, 2012

(54) INKJET RECORDING APPARATUS AND RECORDING HEAD

(75) Inventors: Yoshinori Kato, Nagoya (JP); Nobuo Hiraki, Nagoya (JP); Tomohisa Higuchi, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 866 days.

(21) Appl. No.: 12/238,509

(22) Filed: Sep. 26, 2008

(65) Prior Publication Data

US 2009/0085969 A1 Apr. 2, 2009

(30) Foreign Application Priority Data

Sep. 28, 2007 (JP) ..... 2007-254090

(51) Int. Cl.
*B41J 2/165* (2006.01)

(52) U.S. Cl. ..... 347/33; 347/22

(58) Field of Classification Search ..... 347/20, 347/22, 23, 24, 29, 30, 32, 33
See application file for complete search history.

(56) References Cited

U.S. PATENT DOCUMENTS

| | | | | |
|---|---|---|---|---|
| 6,231,157 | B1 | 5/2001 | Saijo | |
| 6,679,578 | B2 | 1/2004 | Arakawa | |
| 7,063,403 | B2 * | 6/2006 | Wouters | 347/33 |

FOREIGN PATENT DOCUMENTS

| | | | |
|---|---|---|---|
| JP | 03-240554 | * | 10/1991 |
| JP | 4-247957 | A | 9/1992 |
| JP | 11-320915 (A) | | 11/1999 |
| JP | 2001-105616 | A | 4/2001 |
| JP | 2003-1834 | | 1/2003 |

OTHER PUBLICATIONS

Chinese Official Action dated Mar. 24, 2010 with English translation.
Japanese Official Action mailed Nov. 15, 2011 in corresponding Japanese Patent Application No. 2007-01686 together with English language translation.
Japanese Official Action mailed Jan. 31, 2012 in corresponding Japanese Patent Application No. 2007-254090 together with an English language translation.

* cited by examiner

*Primary Examiner* — Geoffrey Mruk
(74) *Attorney, Agent, or Firm* — Scully, Scott, Murphy & Presser, PC

(57) ABSTRACT

An inkjet recording apparatus is provided. The inkjet recording apparatus includes a recording head including a nozzle formation surface, the nozzle formation surface including a plurality of nozzles formed thereon for discharging ink to record an image on a recording medium conveyed to a position opposing the nozzle formation surface; a wiper blade configured to contact the nozzle formation surface to wipe the nozzle formation surface; and an introducing portion formed on a side surface of the recording head intersecting the nozzle formation surface, the introducing portion configured to introduce ink attached to the wiper blade or the nozzle formation surface to the side surface to hold the introduced ink at the side surface.

19 Claims, 10 Drawing Sheets

INKJET RECORDING APPARATUS AND RECORDING HEAD

CROSS-REFERENCE TO RELATED APPLICATION

This application claims priority from Japanese Patent Application No. 2007-254090, filed on Sep. 28, 2007, the entire subject matter of which is incorporated herein by reference.

TECHNICAL FIELD

Aspects of the present invention relate to an inkjet recording apparatus and a recording head.

BACKGROUND

A related art recording head records an image on a recording medium. The recording medium is conveyed to a position opposing a nozzle formation surface having a plurality of ink discharging nozzles formed thereon, and ink is discharged from the nozzles onto the recording medium. A related art inkjet recording apparatus includes such recording head and a wiper blade that contacts the nozzle formation surface of the recording head and wipes ink attached to the nozzle formation surface.

In such recording head and inkjet recording apparatus, Japanese Published Unexamined Patent Application No. 2003-1834 describes a technique to wipe ink W attached to a nozzle surface 6a or a wiper member 86 and hold the wiped ink W in a groove 18 extending along a width direction (main scan direction) of the nozzle surface 6a. The ink W wiped by the wiper member 86 can thereby prevented from dripping into the apparatus.

However, the related art inkjet recording apparatus has some disadvantages. For example, since the groove 18 that holds the ink W is configured to extend along the width direction (main scan direction) of the nozzle surface 6a, the inkjet head 6 that has the nozzle surface 6a increases in width.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an inkjet recording apparatus and a recording head, in which ink that has become attached to a nozzle formation surface or a wiper blade can be suppressed from dripping into the apparatus while preventing increase of width of the recording head as much as possible.

According to an exemplary embodiment of the present invention, there is provided an inkjet recording apparatus including: a recording head including a nozzle formation surface, the nozzle formation surface including a plurality of nozzles formed thereon for discharging ink to record an image on a recording medium conveyed to a position opposing the nozzle formation surface; a wiper blade configured to contact the nozzle formation surface to wipe the nozzle formation surface; and an introducing portion formed on a side surface of the recording head intersecting the nozzle formation surface, the introducing portion configured to introduce ink attached to the wiper blade or the nozzle formation surface to the side surface to hold the introduced ink at the side surface.

According to another exemplary embodiment of the present invention, there is provided a recording head including: a nozzle formation surface including a plurality of ink discharging nozzles formed thereon for discharging ink to record an image on a recording medium conveyed to a position opposing the nozzle formation surface; and a side surface intersecting the nozzle surface, wherein the side surface includes a groove extending in a direction separating from the nozzle formation surface.

According to a further exemplary embodiment of the present invention, there is provided a recording head including: a nozzle formation surface including a plurality of ink discharging nozzles formed thereon for discharging ink to record an image on a recording medium conveyed to a position opposing the nozzle formation surface; and a side surface intersecting the nozzle surface, wherein the side surface includes: a plurality of protrusions extending in a direction separating from the nozzle formation surface and aligned in parallel while being spaced apart mutually by a specific interval; and a recess formed between the adjacent protrusions.

BRIEF DESCRIPTION OF THE DRAWINGS

The above and other aspects of the present invention will become more apparent and more readily appreciated from the following description of exemplary embodiments of the present invention taken in conjunction with the attached drawings, in which:

FIG. 3 shows sectional views of a wiping mechanism of the printer unit of FIG. 2, and in particular.

DETAILED DESCRIPTION

Figure 1:
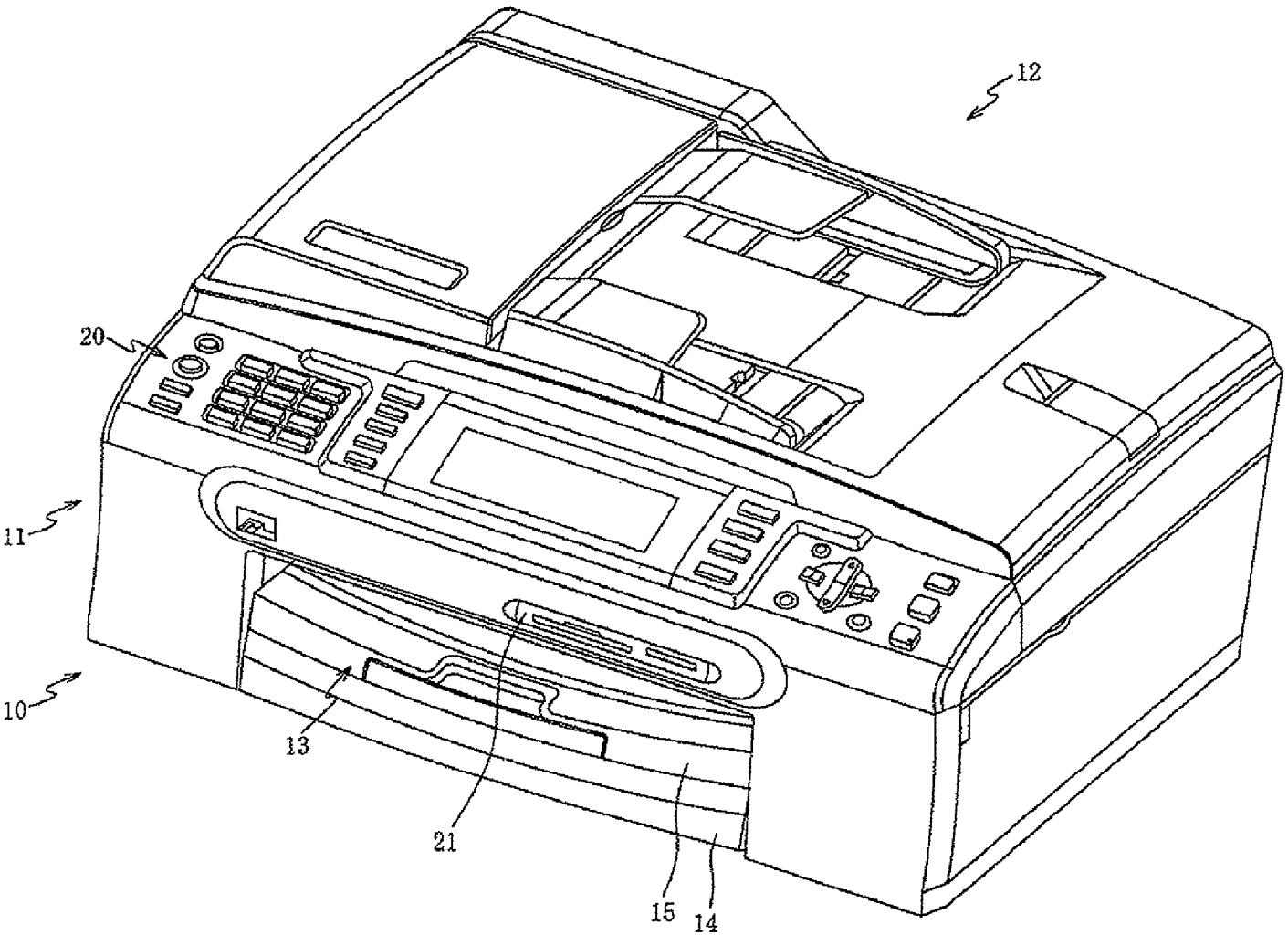
FIG. 1 is an external perspective view of a multi function device according to an embodiment of the present invention.

FIG. 1 is an external perspective view of a multi function device 10 according to an exemplary embodiment of the present invention. A recording head 39 according to an exemplary embodiment (see FIG. 2) is included in the multifunction device 10.

The multi function device (MFD) integrally includes a printer unit 11 at a lower portion and scanner unit 12 at an upper portion, and the MFD 10 has, for example, a printer function, scanner function, copy function, and facsimile function. Functions besides the printer function in the multi function device 10 are arbitrary and may be omitted. That is, the present invention may also be embodied in a single-function printer not having the scanner unit 12 and not having the scanner function or the copy function.

The multi function device 10 may be coupled to a personal computer (not shown). An image or document is printed onto a recording sheet, which is an example of a recording medium, based on printing data, including image data and document data, sent from the personal computer. However, the usage mode of the multi function device 10 is not restricted to the above mode, and the multi function device 10 may be coupled to any external equipment, such as a digital camera, and an image data output from the digital camera may be recorded on a recording sheet, and any of various types of storage media, such as a memory card, etc., may be installed in the multi function device 10 and image data, etc., stored in the storage media may be recorded on a recording sheet.

The printer unit 11 includes an opening 13 formed on a front surface, and a sheet feeding tray 14 and a sheet discharging tray 15 are disposed in two vertical stages in a manner such that portions thereof are exposed from the opening 13. The sheet feeding tray 14 stores recording sheets. A recording sheet contained in the sheet feeding tray 14 is fed to an interior of the printer unit 11 and, after an image is recorded thereon, is discharged to the sheet discharging tray 15.

An operation panel 20 is disposed at a front upper portion of the multi function device 10. The operation panel 20 includes various operation buttons and a liquid crystal display unit for operation of the printer unit 11 and the scanner unit 12. The multi function device 10 operates based on operation instructions from the operation panel 20. In a case where the multi function device 10 is coupled to the personal computer, the multi function device 10 may also operate based on instructions transmitted from the personal computer via a printer driver or a scanner driver.

A slot portion 21 is disposed on the front surface of the multi function device 10. Any of various types of compact memory cards, which are examples of storage media, are enabled to be installed in the slot portion 21. Based on an input from the operation panel 20, image data, recorded in a compact memory card installed in the slot portion 21, are read, and information concerning the image data is displayed on the liquid crystal display unit or an image is recorded on a recording sheet by the printer unit 11.

Figure 2:
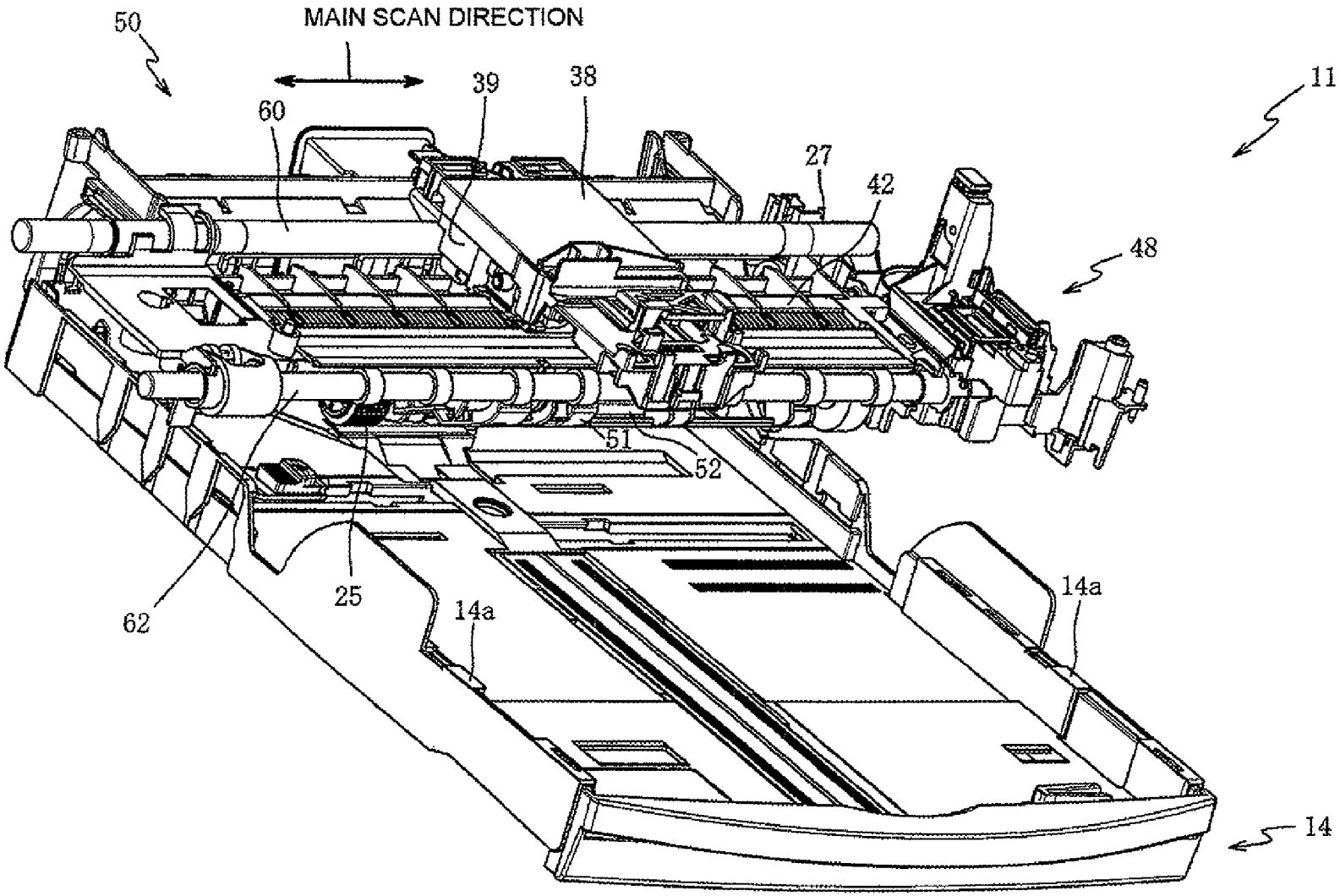
FIG. 2 is a perspective view of an arrangement of a printer unit of the multi function device of FIG. 1.

FIG. 2 is a perspective view of an arrangement of the printer unit 11. The printer unit 11 comprises the sheet feeding tray 14, a feed roller 25, disposed above the sheet feeding tray 14, a conveying guide member 50, erected from an inner side of the sheet feeding tray 14 and forming a conveying path for conveying a recording sheet fed from the feed roller 25, a recording head 39, disposed in a manner enabling reciprocal movement between a conveying roller 60 and a discharge roller 62 at a downstream side of the conveying guide member 50, a platen 42, disposed opposite an ink discharging surface of the recording bead 39, and a maintenance unit 48, disposed at a position adjacent the platen 42 and within a scan range of a carriage 38.

The sheet feeding tray 14 is formed in a substantially box-like shape with an upper side being open, and recording sheets are stacked and housed in an interior of the sheet feeding tray 14. At side walls of the sheet feeding tray 14 are formed supports 14*a* that support the sheet discharging tray 15 (see FIG. 1). The sheet discharging tray 15 is slidably supported on the supports 14*a*.

The feed roller 25 rotates in a state of contacting a recording sheet stacked on the sheet feeding tray 15, and feeds the recording sheet to the conveying roller 60 via a conveying path formed by the conveying guide member 50. The feed roller 25 is axially supported in a manner enabling rotation at one end of an arm 51. The arm 51 is supported in a manner enabling pendulum-like rotation with respect to a shaft 52. An angle formed by the arm 51 and the recording sheet is configured to vary according to an amount of recording sheets stacked on the sheet feeding tray 14. At an interior of the arm 51, a plurality of gears (not shown) are aligned along a straight line and the feed roller 25 is rotated via the gears.

The conveying guide member 50 forms the conveying path by which the recording sheet fed from the feed roller 25 is conveyed to the conveying roller 60. The conveying path is configured in a U-shaped manner. A driven roller (not shown) that rotates so as to follow the conveying roller 60 is disposed opposite the conveying roller 60, and the recording sheet conveyed via the conveying path is sandwiched by the conveying roller 60 and the driven roller and conveyed between the recording head 39 and the platen 42.

The recording head 39 comprises, on a surface opposing the platen 42, a nozzle formation surface, on which nozzles that discharge ink are formed, and an image is formed by discharge of ink droplets from the nozzles onto the recording medium supported by the platen 42 and conveyed to a position opposing the nozzle formation surface. Inks of the various colors, for example of cyan (C), magenta (M), yellow (Y), and black (Bk), are supplied to the recording head 39 from ink cartridges (not shown), detachably installed in the multi function device 10.

The recording head 39 is mounted on the carriage 38 and is configured to be move so as to reciprocate in a main scan direction. The carriage 38 is configured to move in a reciprocating manner across a region opposite the platen 42 and a region opposite the maintenance unit 48. Recording onto the recording medium is executed at the region opposite the platen 42, and maintenance of the recording head 39 is executed at the region opposite the maintenance unit 48.

The platen 42 is disposed opposite and below the recording head 39 and supports the recording sheet, conveyed from the conveying roller 60, from an opposite side with respect to the recording head 39. The recording head 39, to which the inks are supplied, discharges the inks as microscopic ink droplets toward the platen 42 side while moving back and forth and thereby forms an image on the recording sheet conveyed onto the platen 42.

A driven roller (not shown), rotating so as to follow the discharge roller 62, is disposed opposite the discharge roller 62. The discharge roller 62 is disposed so as to sandwich the platen 42 with the conveying roller 60, and the recorded recording sheet, conveyed from between the recording head 39 and the platen 42, is clamped by the feed roller 60 and the driven roller and discharged onto the sheet discharging tray 15 (see FIG. 1).

The maintenance unit 48 includes a wiping mechanism, a purge mechanism, and a waste ink tray, etc. The wiping mechanism executes a wiping process of wiping off ink from the nozzle formation surface of the recording head 39, with a wiper blade having elasticity. The purging mechanism executes a purging process of drawing in ink from the nozzles, formed on the nozzle formation surface, in a state of closely sealing the nozzle formation surface of the recording head 39. Maintenance, such as removal of bubbles and mixed-color ink inside the recording head 39, etc., is performed by the maintenance unit 48.

The maintenance unit 48 is provided with a carriage lever 27, and when the carriage 38 moves to a position opposite the maintenance unit 48, the carriage lever 27 is pushed down and a moving force of a line feed (LF) motor (not shown) becomes transmitted to the maintenance unit 48.

Figure 3B:
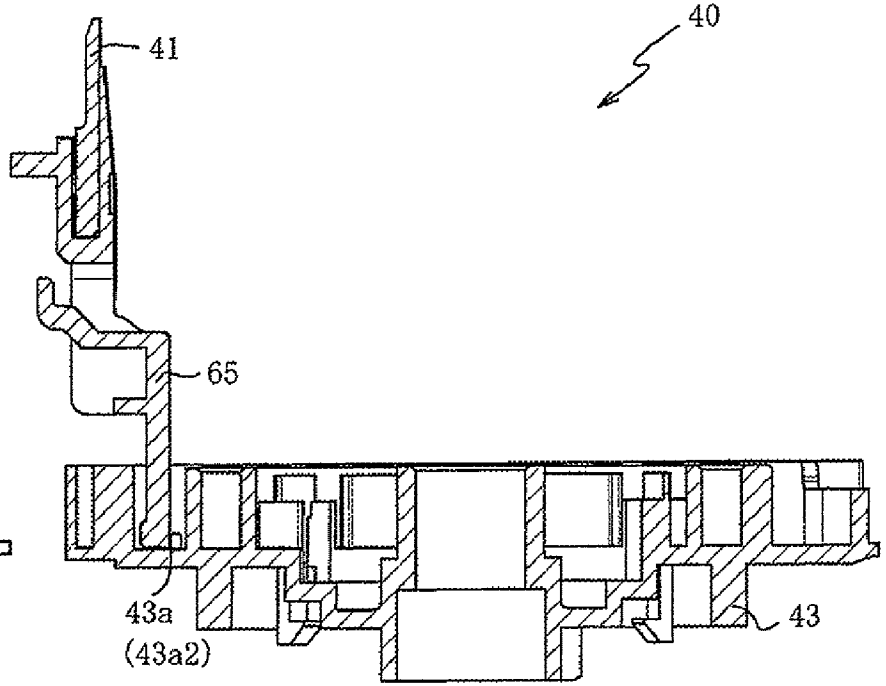
FIG. 3B is a sectional view of the wiper mechanism in a state in which the wiper blade is separated from the nozzle formation surface.
Figure 3A:
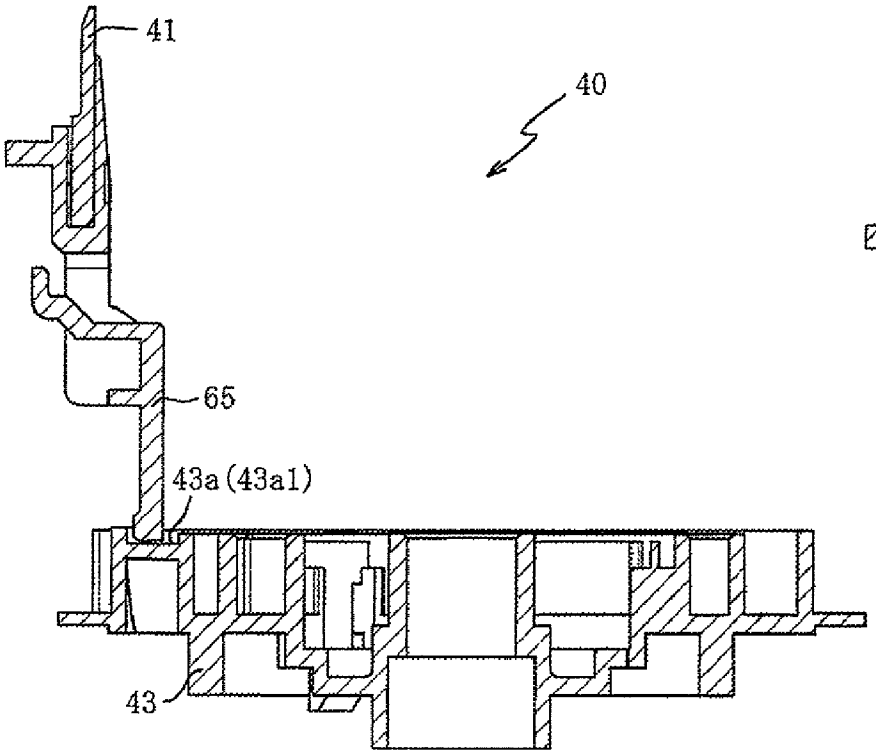
FIG. 3A is a sectional view of the wiper mechanism in a state in which a wiper blade contacts a nozzle formation surface.

The wiping mechanism 40, included in the maintenance unit 48, shall now be described with reference to FIG. 3. FIG. 3 shows sectional views of the wiping mechanism 40, and in particular, FIG. 3A shows a state in which the wiper blade 41 contacts the nozzle formation surface, and FIG. 3B shows a state in which the wiper blade 41 is separated from the nozzle formation surface.

The wiping mechanism 40 is disposed as a portion of the maintenance unit 48, and is set at a position that opposes the recording head 39 when the recording head 39, mounted on the carriage 38, moves to the region opposing the maintenance unit 48.

As shown in FIG. 3, the wiping mechanism 40 includes the wiper blade 41 which has a plate-like shape with elasticity, a wiper holder 65, holding one end of the wiper blade 41, and a rotating member 43, holding the other end side of the wiper holder 65.

The wiper blade 41 and the wiper holder 65 are disposed so as to be able to retractably protrude from the rotating member 43 toward the nozzle formation surface of the recording head 39. The wiper blade 41 is, for example, a rubber blade with a length corresponding to a length in a conveying direction of a lower surface of the recording head 39. By being protruded from the rotating member 43 side, the wiper blade 41 is put in contact with the nozzle formation surface of the recording head 39 with a tip portion of the wiper blade 41 being put in a flexed state. The recording head 39 is slidingly moved along with the carriage 38 with the wiper blade 41 being in contact with the nozzle formation surface of the recording head 39. Ink attached to the nozzle formation surface is thereby wiped off by the wiper blade 41.

The wiper holder 65 is disposed so as to be able to retractably protrude toward the nozzle formation surface of the recording head 39 in accordance with a rotation of the rotating member 43 to be described later. By the wiper holder 65 protruding from the rotating member 43 toward the nozzle formation surface side, the wiper blade 41 supported by the wiper holder 65 is put in contact with the nozzle formation surface. By contrast, by the wiper holder 65 retracting toward the rotating member 43 side, the wiper blade 41 is separated from the nozzle formation surface.

The rotating member 43 makes the wiper holder 65 (along with the wiper blade 41) protrude and retract with respect to the nozzle formation surface of the recording head 39 and is rotatably disposed at a position at which the rotating member 43 sandwiches the wiper holder 65 and the wiper blade 41 with the nozzle formation surface of the recording head 39.

An annular cam groove 43*a* is formed in the rotating member 43. In the cam groove 43*a* are formed a first groove portion (43*a*1), in which a groove depth is a first depth across a certain range, and a second groove portion (43*a*2), in which the groove depth is a second depth that is deeper than the first depth and which is formed so as to be continuous with both ends of the first groove portion (43*a*1).

Thus, when the wiper holder 65 is positioned on the first groove portion (43*a*1), the wiper holder 65 protrudes from the rotating member 43 toward the nozzle formation surface side and the wiper blade 41 contacts the nozzle formation surface. Alternatively, when the wiper holder 65 is positioned on the second groove portion (43*a*2), the wiper holder 65 retracts into the rotating member 43 side and the wiper blade 41 separates from the nozzle formation surface. The wiper holder 65 is urged into the rotating member 43 by a coil spring (not shown) and thereby configured to protrude and retract readily in accordance with the cam groove 43*a*.

Figure 4:
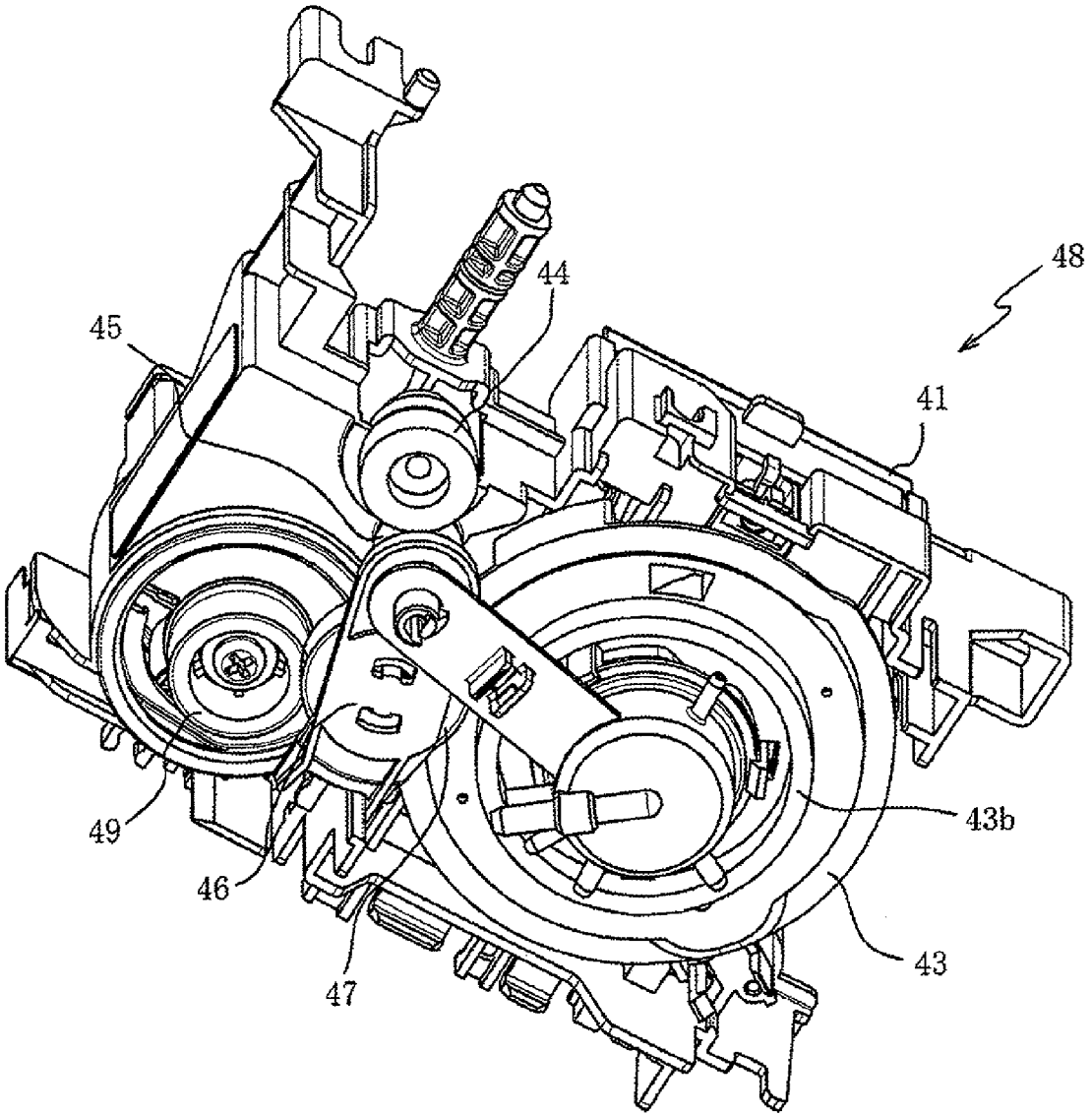
FIG. 4 is a perspective view of a rotating member of the wiper mechanism of FIGS. 3A and 3B as viewed from a bottom surface side.

A power transmission mechanism that rotates the rotating member 43 shall now be described with reference to FIG. 4. FIG. 4 is a perspective view of the rotating member 43 as viewed from a bottom surface side. As shown in FIG. 4, the power transmission mechanism that rotates the rotating member 43 includes a first gear 44, a second gear 45, engaging with the first gear 44, a link bar 46, having one end coupled to the second gear 45, and a third gear 47, coupled to the other end of the link bar 46.

In a state in which the carriage 38 has moved to a position opposing the maintenance unit 48 and the carriage lever 27 is pushed down, the LF motor is driven. The LF motor serves as a power source. A rotating force of the LF motor 71 is transmitted via a gear mechanism (not shown) to the first gear 44. For example, the first gear 44 rotates counterclockwise, as shown in FIG. 4. The second gear 45 and the link bar 46 then rotate clockwise in FIG. 4, and the third gear 47 engages with a fourth gear 49 for driving a pump to be used to execute the purging process.

When the LF motor 71 is rotated in a reverse direction, the first gear 44 rotates clockwise in FIG. 4. The second gear 45 and the link bar 46 then rotate counterclockwise, the third gear 47 engages with a fifth gear 43*b*, formed on the bottom surface of the rotating member 43, and the rotating member 43 is thereby driven to rotate. When the rotating member 43 is driven to rotate the wiper holder 65 (along with the wiper blade 41) follows the cam groove 43*a*, formed in the rotating member 43, and protrudes and retracts with respect to the nozzle formation surface of the recording head 39.

Figure 5:
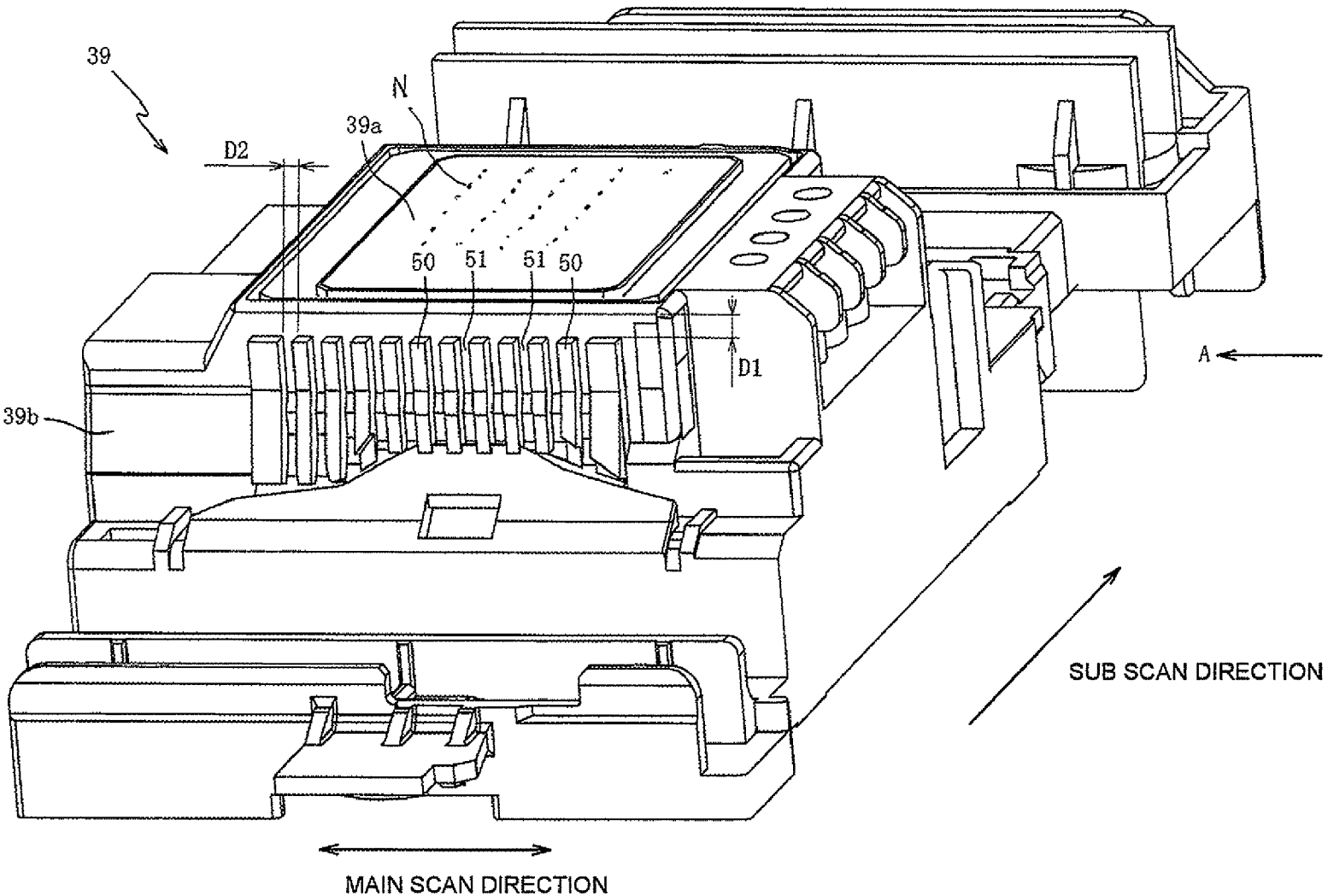
FIG. 5 is a perspective view of a recording head according to a first exemplary embodiment as viewed from a nozzle formation surface side.
Figure 6:
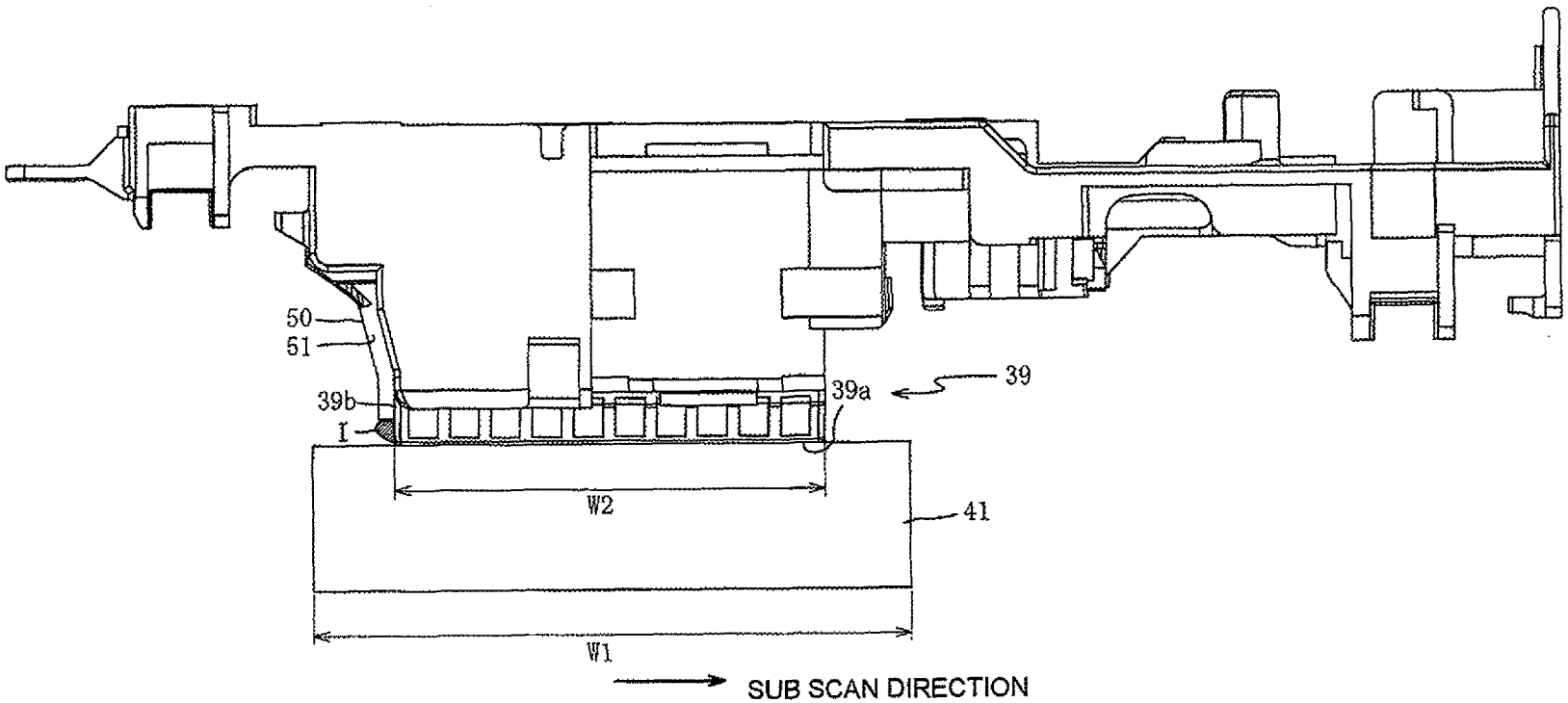
FIG. 6 is a side view of the recording head according to the first exemplary embodiment and a wiper blade as viewed from the direction of the arrow A shown in FIG. 5.

The recording head 39 according to a first exemplary embodiment including a nozzle formation surface 39*a* will now be described in detail with reference to FIGS. 5 and 6. The tip of the wiper blade 41 contacts with the nozzle formation surface 39*a*. FIG. 5 is a perspective view of the recording head 39 according to the first exemplary embodiment as viewed from the nozzle formation surface 39*a* side. FIG. 6 is a side view of the recording head 39 according to the first exemplary embodiment and the wiper blade 41 as viewed from the direction of the arrow A shown in FIG. 5. In FIGS. 5 and 6, a direction, in which the recording head 39 reciprocates, is a main scan direction, and a direction, which is orthogonal to the main scan direction and in which the recording medium is conveyed, is a sub scan direction.

The recording head 39 has a substantially box-like shape and includes the nozzle formation surface 39*a* on which the plurality of nozzles N for discharging ink are formed, and a side surface 39*b* extending in a direction separating from the nozzle formation surface 39*a* from an edge of the nozzle formation surface 39*a* (a direction substantially orthogonal to the nozzle formation surface 39*a*).

The nozzle formation surface 39*a* opposes the conveyed recording medium and ink is discharged from the nozzles N to record an image on the conveyed recording medium. On the side surface 39*b* are formed a plurality of protrusions 50 and a plurality of recesses 51. The plurality of protrusions 50 extend in the direction separating from the nozzle formation surface 39*a* from a position spaced apart by a specific interval D1 from the nozzle formation surface 39*a* and aligned in parallel while being spaced apart mutually by a specific interval D2. The plurality of recesses 51 are formed between adjacent protrusions 50.

Meanwhile, as shown in FIG. 6, a width W1 of the wiper blade 41 in the sub scan direction is set longer than a width W2 of the nozzle formation surface 39*a* in the sub scan direction. The wiper blade 41 is disposed so that, while contacting the entire width W2 of the nozzle formation surface 39*a* in the sub scan direction, an end thereof protrudes to the side surface 39*b* side in the sub scan direction.

Thus, when the wiper blade 41 is made to contact the nozzle formation surface 39*a* and the wiping process is executed, an entirety of the nozzle formation surface 39*a* is wiped by the wiper blade 41. Ink I attached to the nozzle formation surface 39*a* is introduced directly or via the wiper blade 41 to the side surface 39*a* and held at the side surface 39*b* of the recording head 39 by a capillary action of the recesses 51 formed on the side surface 39*b* of the recording head 39.

The ink attached to the nozzle formation surface 39*a* and the wiper blade 41 is thus suppressed from dripping into the apparatus. Also, since the protrusions 50 and the recesses 51 are formed on the side surface 39*b* of the recording head 39 so as to extend in the direction separating from the nozzle formation surface 39*a*, even when the protrusions 50 and the recesses 51 are formed on the recording head 39, increase of widths (width in the main scan direction and width in the sub scan direction) of the recording head 39 is suppressed. Consequently, the ink attached to the nozzle formation surface 39*a* and the wiper blade 41 can be suppressed from dripping into the apparatus while preventing increase of the widths of the recording head 39 as much as possible.

Figure 7:
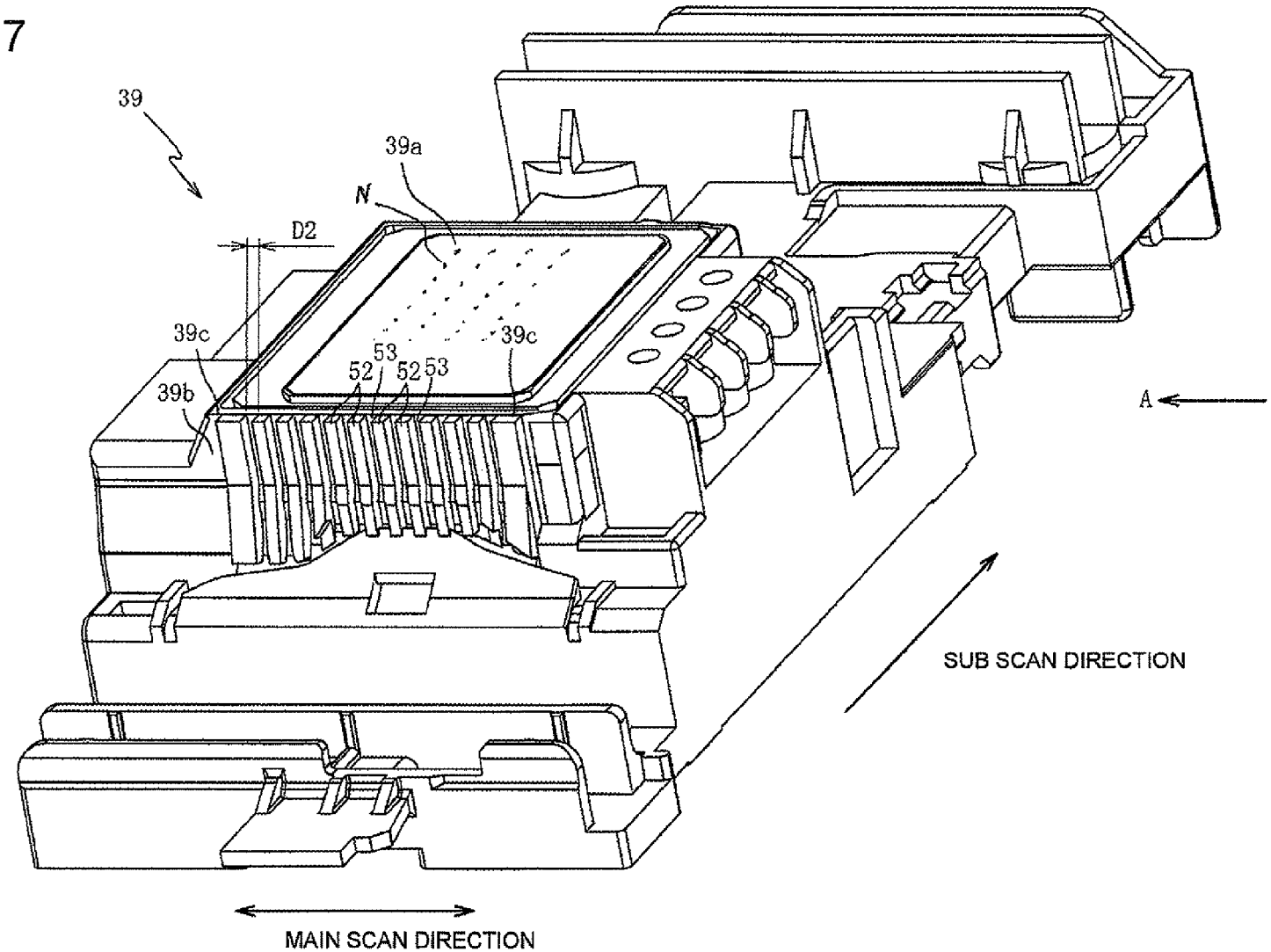
FIG. 7 is a perspective view of a recording head according to a second exemplary embodiment as viewed from a nozzle formation surface side.
Figure 8:
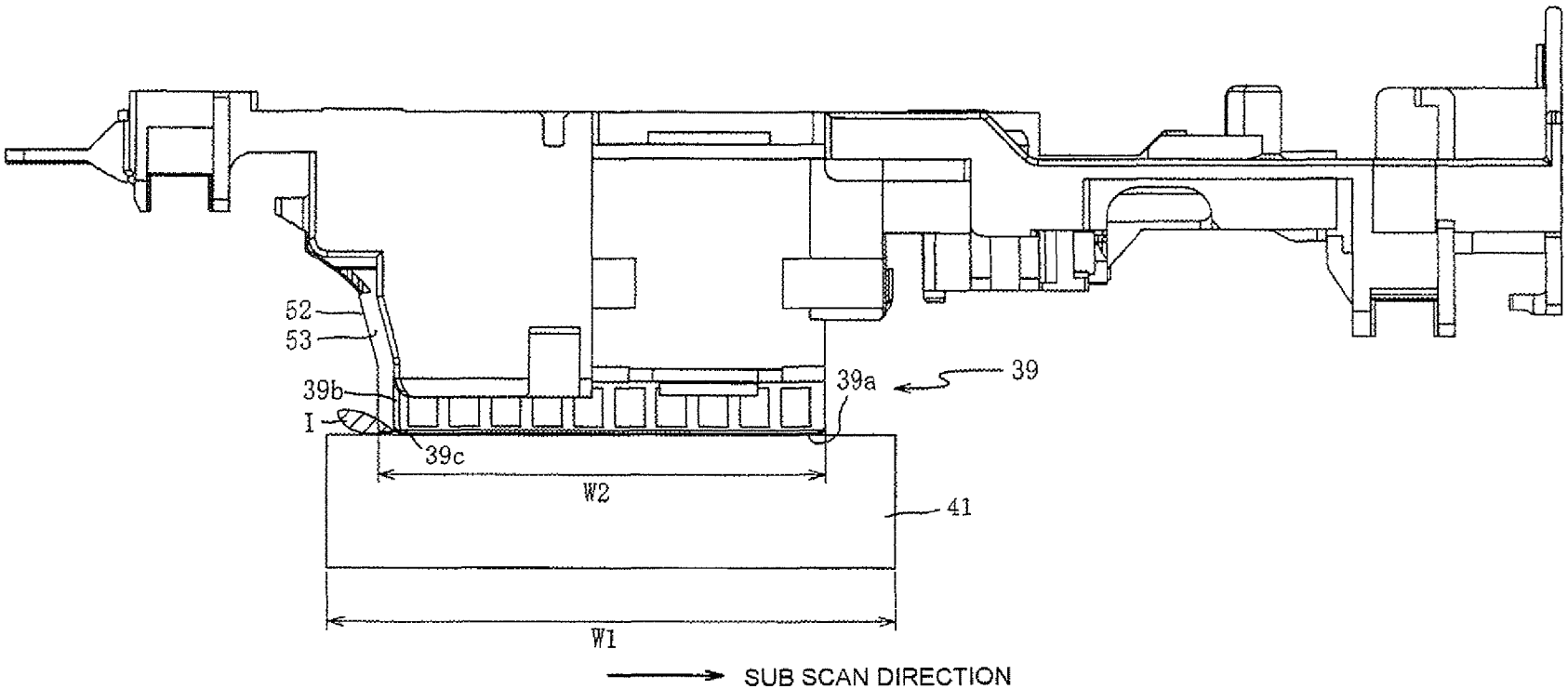
FIG. 8 is a side view of the recording head according to the second exemplary embodiment and a wiper blade as viewed from the direction of the arrow A shown in FIG. 7.

The recording head 39 according to a second exemplary embodiment will now be described in detail with reference to FIGS. 7 and 8. FIG. 7 is a perspective view of the recording head 39 according to the second exemplary embodiment as viewed from the nozzle formation surface 39*a* side. FIG. 8 is a side view of the recording head 39 according to the second exemplary embodiment and the wiper blade 41 as viewed from the direction of the arrow A shown in FIG. 7. With the recording head 39 according to the second exemplary embodiment, arrangements that are the same as those of the first exemplary embodiment described above will be provided with the same reference numerals and description thereof will be omitted.

On the side surface 39*b* of the recording head 39 according to the second exemplary embodiment are formed a plurality of protrusions 52 and a plurality of recesses 53. The plurality of protrusions extend in a direction separating from the nozzle formation surface 39*a* from an intersection portion 39*c* of intersection with the nozzle formation surface 39*a* (direction substantially orthogonal to the nozzle formation surface 39*a*) and aligned in parallel while being spaced apart mutually by the specific interval D2. The plurality of recesses 53 are formed between adjacent protrusions 52.

Thus when, as shown in FIG. 8, the wiper blade 41 is made to contact the nozzle formation surface 39*a* and the wiping process is executed, the ink I attached to the nozzle formation surface 39*a* is introduced directly or via the wiper blade 41 to the side surface 39*b* and held at the side surface 39*b* of the recording head 39 by a capillary action of the recesses 53 formed on the side surface 39*b* of the recording head 39.

The ink attached to the nozzle formation surface 39*a* and the wiper blade 41 is thus suppressed from dripping into the apparatus. Also, since the protrusions 52 and the recesses 53 are formed on the side surface 39*b* of the recording head 39 so as to extend in the direction separating from the nozzle formation surface 39*a*, even when the protrusions 52 and the recesses 53 are formed on the recording head 39, increase of the widths (width in the main scan direction and width in the sub scan direction) of the recording head 39 is suppressed. Furthermore with the recording head 39 according to the second exemplary embodiment, since the protrusions 52 and the recesses 53 extend from the intersection portion 39*c* of the side surface 39*b* of the recording head 39 that intersects the nozzle formation surface 39*a*, the ink I may be more readily introduced into the recesses 53 from the nozzle formation surface 39*a* side than in the recording bead 39 according to the first exemplary embodiment. Consequently, the ink attached to the nozzle formation surface 39*a* and the wiper blade 41 can be suppressed more reliably from dripping into the apparatus while preventing increase of the widths of the recording head 39 as much as possible.

Figure 9:
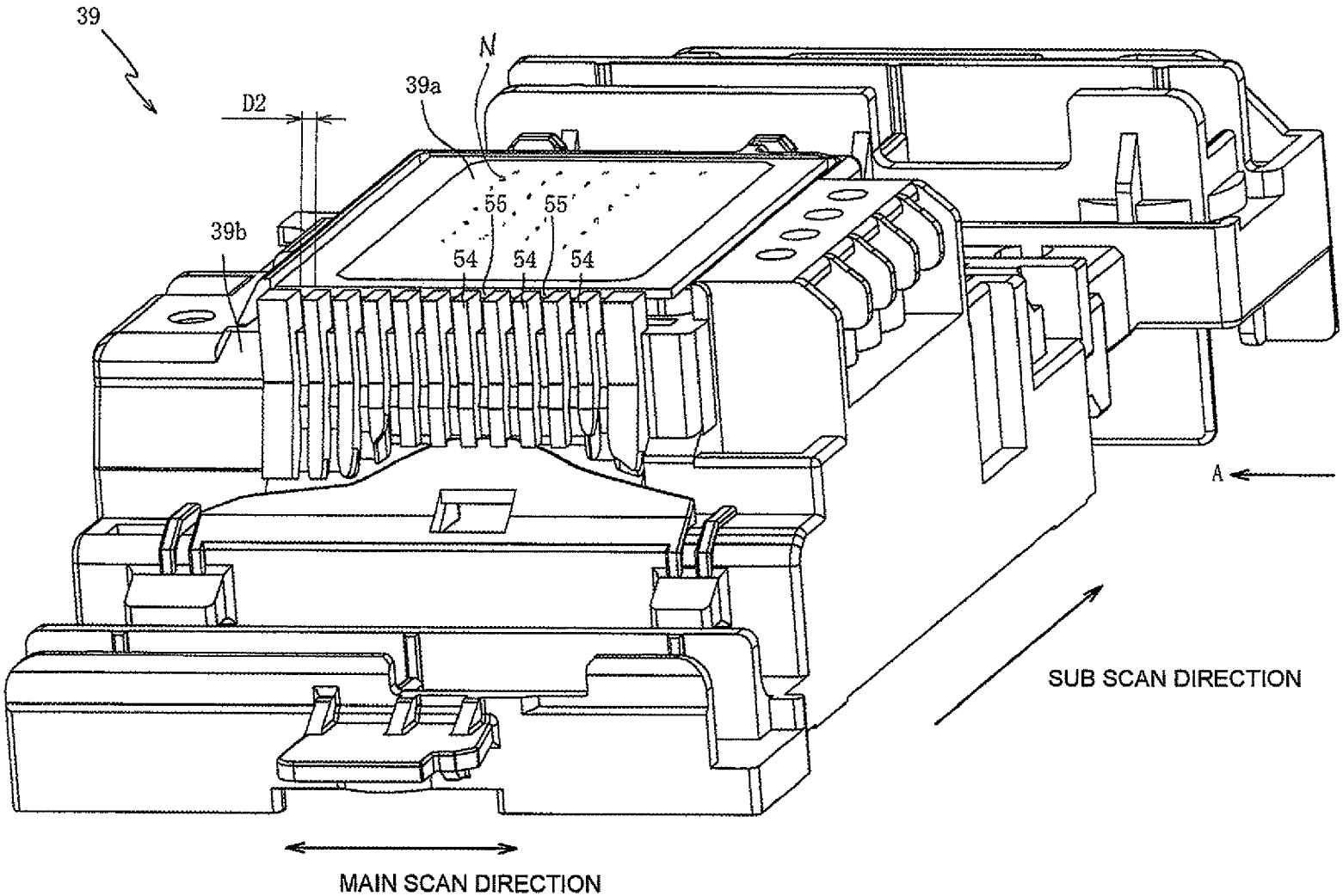
FIG. 9 is a perspective view of a recording head according to a third exemplary embodiment as viewed from a nozzle formation surface side.
Figure 10:
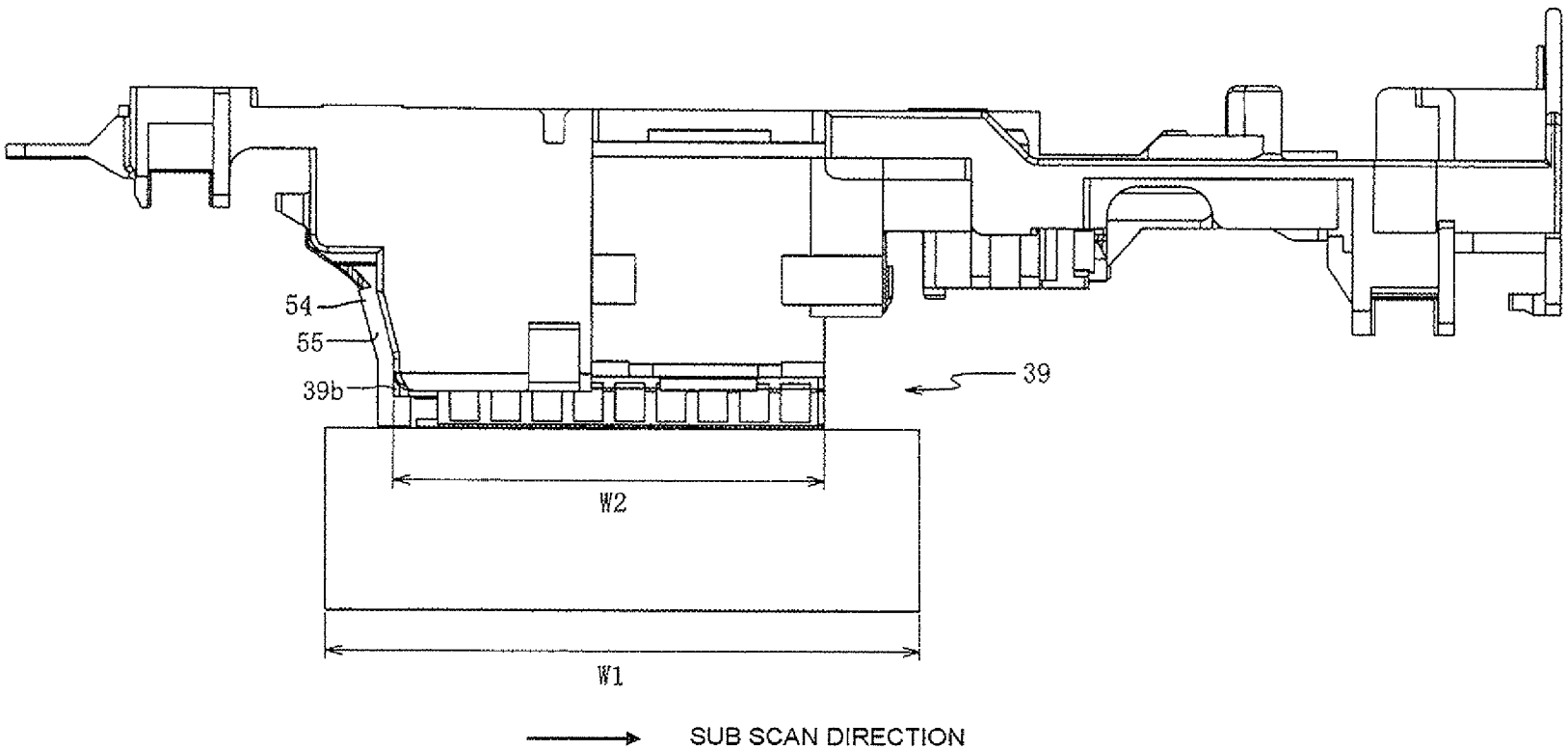
FIG. 10 is a side view of the recording head according to the third exemplary embodiment and a wiper blade as viewed from the direction of the arrow A shown in FIG. 9.

The recording head 39 according to a third exemplary embodiment will now be described in detail with reference to FIGS. 9 and 10. FIG. 9 is a perspective view of the recording head 39 according to the third exemplary embodiment as viewed from the nozzle formation surface 39*a* side. FIG. 10 is a side view of the recording head 39 according to the third exemplary embodiment and the wiper blade 41 as viewed from the direction of the arrow A shown in FIG. 9. With the recording head 39 according to the third exemplary embodiment, arrangements that are the same as those of the first and second exemplary embodiments described above will be provided with the same reference numerals and description thereof will be omitted.

On the side surface 39*b* of the recording head 39 according to the third exemplary embodiment are formed a plurality of protrusions 54 and a plurality of recesses 55. The plurality of protrusions 54 are bent from the nozzle formation surface 39*a* at the side surface 39*b*, extend in a direction separating from the nozzle formation surface 39*a*, and is aligned in parallel while being spaced apart mutually by a specific interval D2. In other words, the protrusions 54 extend in a direction parallel to the nozzle formation surface 39*a* and then extend in the direction separating from the nozzle formation surface 39*a*. Further, in other words, the protrusion length of the protrusions 54 from the side surface 39*b* becomes longer as the distance from the nozzle formation surface 39*a* longer. The plurality of recesses 55 are formed between adjacent protrusions 54.

Thus when, as shown in FIG. 10, the wiper blade 41 is made to contact the nozzle formation surface 39*a* and the wiping process is executed, the ink I attached to the nozzle formation surface 39*a* is introduced directly or via the wiper blade 41 and held at the side surface 39*b* of the recording head 39 by a capillary action of the recesses 55 formed on the side surface 39*b* of the recording head 39.

The ink attached to the nozzle formation surface 39*a* and the wiper blade 41 is thus suppressed from dripping into the apparatus. Also, since the protrusions 54 and the recesses 55 are formed on the side surface 39*b* of the recording head 39 so as to extend in the direction separating from the nozzle formation surface 39*a*, even when the protrusions 54 and the recesses 55 are formed on the recording head 39, increase of widths (width in the main scan direction and width in the sub scan direction) of the recording head 39 is suppressed. Furthermore with the recording head 39 according to the third exemplary embodiment, since the protrusions 54 and the recesses 55 are bent from the nozzle formation surface 39*a* at the side surface 39*b* and extend in the direction of separating from the nozzle formation surface 39*a*, the ink I is more readily introduced into the recesses 55 from the nozzle formation surface 39*a* side than in the recording heads 39 according to the first and second exemplary embodiments. Consequently, the ink attached to the nozzle formation surface 39*a* and the wiper blade 41 can be suppressed more reliably from dripping into the apparatus while preventing increase of the widths of the recording head 39 as much as possible.

While the present invention has been shown and described with reference to certain exemplary embodiments thereof, it will be understood by those skilled in the art that various changes in form and details may be made therein without departing from the spirit and scope of the invention as defined by the appended claims.

Although with the exemplary embodiments described above, cases of forming the protrusions 50, 52, and 54 and the recesses 51, 53, and 55 on the recording head 39 were described, in place of the protrusions 50, 52, and 54 and the recesses 51, 53, and 55, a grooves or grooves that are bent from the nozzle formation surface 39*a* at the side surface 39*b* may be formed on the side surface 39*b* of the recording head 39. The same effects as those described above can be exhibited in this case as well.

Also, the above-described grooves or protrusions 50, 52, or 54 and the recesses 51, 53, or 55 may be formed not just on the side surface 39*b* at an upstream side in the sub scan direction of the recording head 39 but may also be formed on a side surface at a downstream side in the sub scan direction of the recording head 39 and side surfaces at an upstream side and a downstream side in the main scan direction of the recording head 39. In this case, the amount of ink that can be introduced into the grooves or the protrusions 50, 52, or 54 and the recesses 51, 53, or 55 can be increased and the ink attached to the nozzle formation surface 39*a* can be introduced to the side surfaces of the recording head 39 more reliably.

Although with the above-described exemplary embodiments, the distance of separation of the protrusions 50, 52, or 54 and the recesses 51, 53, or 55 from the nozzle formation surface 39*a* was not defined in particular, arrangements can be made so that the distance in the direction of separating from the nozzle formation surface 39*a* of the protrusions 50, 52, or 54 and the recesses 51, 53, or 55 gradually becomes longer along the direction in which the wiper blade 41 moves relative to the recording head 39.

By this arrangement, even if the amount of ink introduced to the side surface of the recording head 39 increases as the nozzle formation surface 39*a* is wiped by the wiper blade 41, the ink can be introduced reliably into the recesses 51, 53, or 55 and the recording head 39 can be made more lightweight in comparison to the case where the distance is made uniform. Likewise, with the condition that a capillary action occurs, arrangements can be made so that the intervals between adjacent protrusions 50, 52, or 54 become gradually narrower along the direction in which the wiper blade 41 moves relative to the recording head 39.

In a case where the protrusions 50, 52, or 54 and the recesses 51, 53, or 55 are formed on the side surfaces at the upstream and downstream sides in the main scan direction of the recording head 39, a protruding absorbing member (for example, a sponge) that fits with the recesses 51, 53, or 55 may be disposed on a wall surface inside the device for absorption of the ink introduced into the recesses 51, 53, or 55. In this case, the ink introduced into the recesses 51, 53, or 55 is absorbed by the absorbing member and the amount of ink introduced into the recesses 51, 53, or 55 can be increased further.

What is claimed is:

1. An inkjet recording apparatus comprising:

a recording head including a nozzle formation surface, the nozzle formation surface including a plurality of nozzles formed thereon for discharging ink to record an image on a recording medium conveyed to a position opposing the nozzle formation surface;

a wiper blade configured to contact the nozzle formation surface to wipe the nozzle formation surface;

an introducing portion formed on a side surface of the recording head intersecting the nozzle formation surface, the introducing portion configured to introduce ink attached to the wiper blade or the nozzle formation surface to the side surface to hold the introduced ink at the side surface, wherein the recording head is moved in a main scan direction with respect to the wiper blade, wherein the side surface is in parallel to the main scan direction, and wherein the introducing portion comprises a groove extending in a direction separating from the nozzle formation surface from a position of the side surface spaced apart by a specific interval from the nozzle formation surface.

2. The inkjet recording apparatus according to claim 1, wherein the introducing portion comprises:

a plurality of protrusions extending in a direction separating from the nozzle formation surface from a position of the side surface spaced apart by a specific interval from the nozzle formation surface and aligned in parallel while being spaced apart mutually by a specific interval; and a recess formed between the adjacent protrusions.

3. The inkjet recording apparatus according to claim 1, wherein the introducing portion comprises a groove extending in a direction separating from the nozzle formation surface from an intersection portion at which the side surface intersects the nozzle formation surface.

4. The inkjet recording apparatus according to claim 1, wherein the introducing portion comprises:

a plurality of protrusions extending in a direction separating from the nozzle formation surface from an intersection portion at which the side surface intersects the nozzle formation surface, and aligned in parallel while being spaced apart mutually by a specific interval; and a recess formed between the adjacent protrusions.

5. The inkjet recording apparatus according to claim 1, wherein the introducing portion comprises a groove bent from the nozzle formation surface to the side surface and extending in a direction separating from the nozzle formation surface.

6. The inkjet recording apparatus according to claim 1, wherein the introducing portion comprises:

a plurality of protrusions bent from the nozzle formation surface to the side surface and extending in a direction separating from the nozzle formation surface, and aligned in parallel while being spaced apart mutually by a specific interval, and a recess formed between the adjacent protrusions.

7. The inkjet recording apparatus according to claim 1, wherein a width of the wiper blade in a sub scan direction orthogonal to the main scan direction is longer than a width of the nozzle formation surface in the sub scan direction, and wherein the wiper blade is disposed so that an end of the wiper blade protrudes to a side surface side in the sub scan direction while contacting an entire width of the nozzle formation surface in the sub scan direction.

8. The inkjet recording apparatus according to claim 1, wherein the side surface is orthogonal to the nozzle formation surface.

9. The inkjet recording apparatus according to claim 1, wherein the recording head is moved in the main scan direction while the wiper blade wipes the nozzle formation surface, wherein the introducing portion includes:

a plurality of protrusions extending in a direction orthogonal to the nozzle formation surface and aligned in parallel while being spaced apart mutually by a specific interval; and a recess formed between the adjacent protrusions, and wherein extending distances of the plurality of protrusions becomes longer along the main scan direction.

10. The inkjet recording apparatus according to claim 1, wherein the recording head is moved in the main scan direction while the wiper blade wipes the nozzle formation surface, wherein the introducing portion includes:

a plurality of protrusions extending in a direction orthogonal to the nozzle formation surface and aligned in parallel while being spaced apart mutually by a specific interval; and a recess formed between the adjacent protrusions, and wherein intervals between the adjacent protrusions becomes narrower along the main scan direction.

11. A recording head comprising:

a nozzle formation surface including a plurality of ink discharging nozzles formed thereon for discharging ink to record an image on a recording medium conveyed to a position opposing the nozzle formation surface, wherein the plurality of ink discharging nozzles are aligned in a first direction and a second direction orthogonal to the first direction on the nozzle formation surface, and the number of ink discharging nozzles aligned in the first direction is smaller than the number of ink discharging nozzles aligned in the second direction; and a side surface intersecting the nozzle formation surface and in parallel to the first direction, wherein the side surface includes a groove extending in a direction separating from the nozzle formation surface.

12. The recording head according to claim 11, wherein the groove extends from a position spaced apart by a specific interval from the nozzle formation surface in the direction separating from the nozzle formation surface.

13. The recording head according to claim 11, wherein the groove extends, from an intersecting position at which the side surface intersects the nozzle formation surface, in the direction separating from the nozzle formation surface.

14. The recording head according to claim 11, wherein the groove is bent from the nozzle formation surface to the side surface and extends in the direction separating from the nozzle formation surface.

15. The recording head according to claim 11, wherein a plurality of the grooves are aligned in parallel.

16. A recording head comprising:

a nozzle formation surface including a plurality of ink discharging nozzles formed thereon for discharging ink to record an image on a recording medium conveyed to a position opposing the nozzle formation surface, wherein the plurality of ink discharging nozzles are aligned in a first direction and a second direction orthogonal to the first direction on the nozzle formation surface, and the number of ink discharging nozzles aligned in the first direction is smaller than the number of ink discharging nozzles aligned in the second direction; and a side surface intersecting the nozzle formation surface and in parallel to the first direction, wherein the side surface includes:

a plurality of protrusions extending in a direction separating from the nozzle formation surface and aligned in parallel while being spaced apart mutually by a specific interval; and a recess formed between the adjacent protrusions.

17. The recording head according to claim 16, wherein the plurality of protrusions extend from a position spaced apart by a specific interval from the nozzle formation surface in the direction separating from the nozzle formation surface.

18. The recording head according to claim 16, wherein the plurality of protrusions extend, from an intersecting position at which the side surface intersects the nozzle formation surface, in the direction separating from the nozzle formation surface.

19. The recording head according to claim 16, wherein the plurality of protrusions are bent from the nozzle formation surface to the side surface and extend in the direction separating from the nozzle formation surface.

* * * * *